United States Patent [19]

Boyce, II

[11] 4,350,111

[45] Sep. 21, 1982

[54] LATERALLY AND VERTICALLY CONTROLLABLE UNDERWATER TOWED VEHICLE

[76] Inventor: William D. Boyce, II, 1 Blvd de la Gare, Valmondois, France, 95760

[21] Appl. No.: 154,891

[22] Filed: May 30, 1980

[51] Int. Cl.[3] ..... B63G 8/14

[52] U.S. Cl. ..... 114/245

[58] Field of Search ..... 114/242, 244, 245-249, 114/251-253, 330-332; 367/104

[56] References Cited

U.S. PATENT DOCUMENTS

| | | | |
|---|---|---|---|
| 2,929,348 | 3/1960 | Jackson | 114/253 |
| 3,224,405 | 12/1965 | Fergusson et al. | 114/244 |
| 3,560,912 | 2/1971 | Spink et al. | 114/245 |
| 3,613,626 | 10/1971 | Kelly et al. | 114/244 |

*Primary Examiner*—Trygve M. Blix
*Assistant Examiner*—Jesús D. Sotelo
*Attorney, Agent, or Firm*—Fleit & Jacobson

[57] ABSTRACT

A towed underwater vehicle that is laterally and vertically movable with respect to a towing vessel connected by a tow cable to the vehicle. Such movement of the vehicle is obtained by the interaction of a horizontally and vertically movable point of attachment of the tow cable to the vehicle, horizontal and vertical planing surfaces provided on the vehicle, and appropriate stabilization of the vehicle. Such stabilization is obtained by adding buoyant materials to upper portions of the vehicle, ballast to lower portions of the vehicle, use of adjustable ailerons or adjustable horizontal and vertical planing surfaces, or a combination of the preceding. When the point of attachment between the cable and the towed vehicle is changed, the forces exerted by the cable on the vehicle are changed so that the planing surfaces of the vehicle present an increased frontal area to water flowing past the vehicle. The increased frontal area struck by the water results in movement of the vehicle to minimize the frontal area. Such movement of the vehicle carries with it the point of attachment to the two cable and varies the position of the towed vehicle with respect to the towing vessel. Such movement is in lateral, vertical, or in both directions.

16 Claims, 18 Drawing Figures

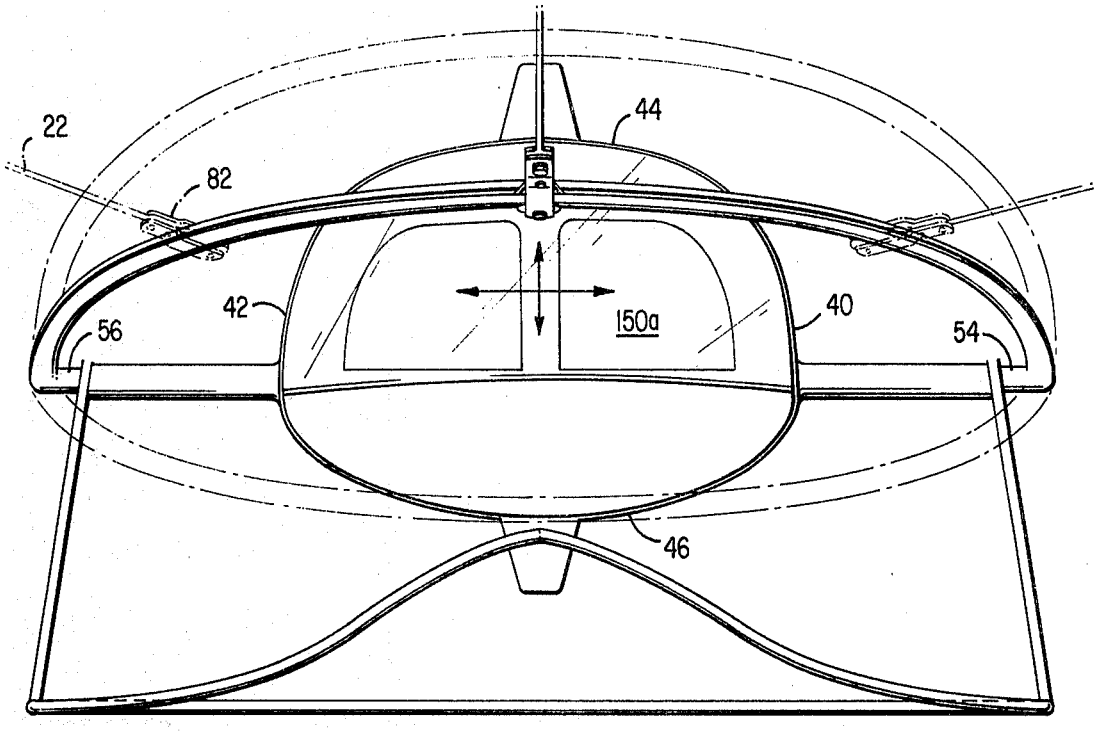
FIG. 2
FIG. 3
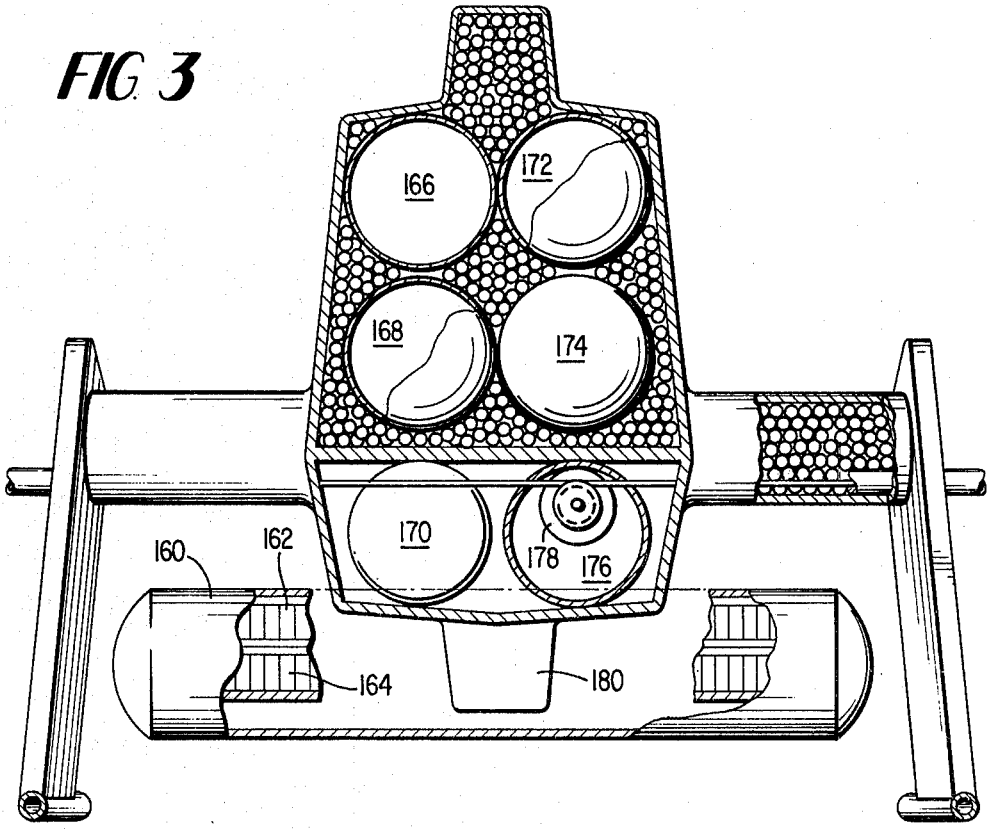

FIG 5
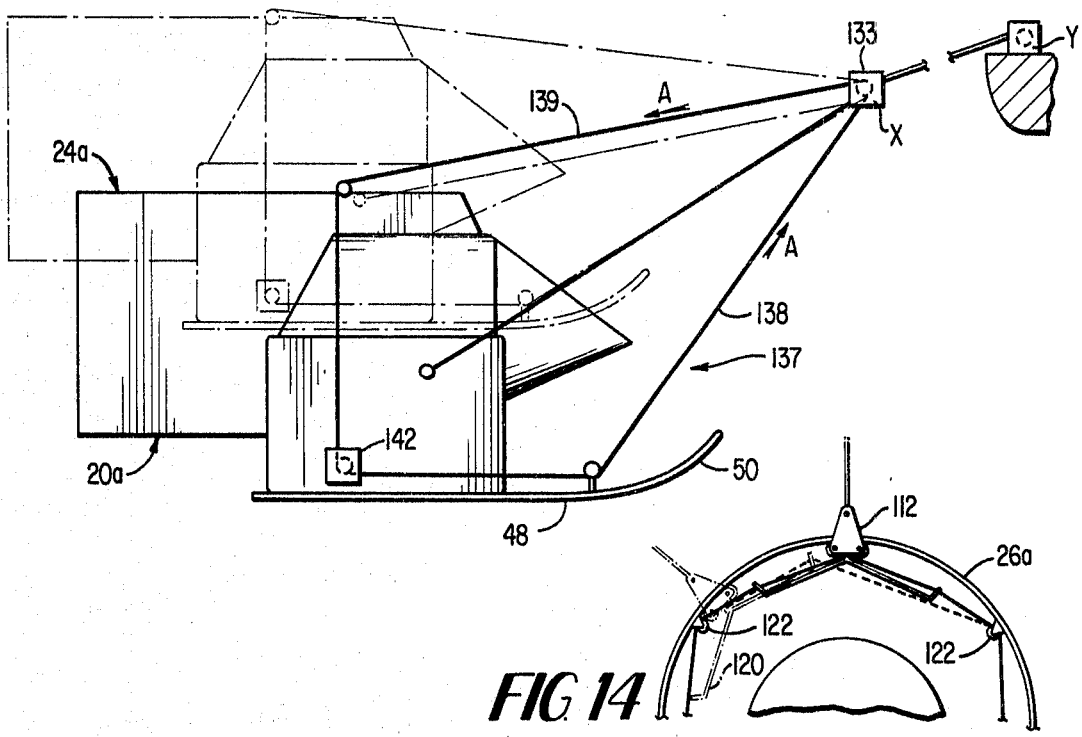
FIG 14
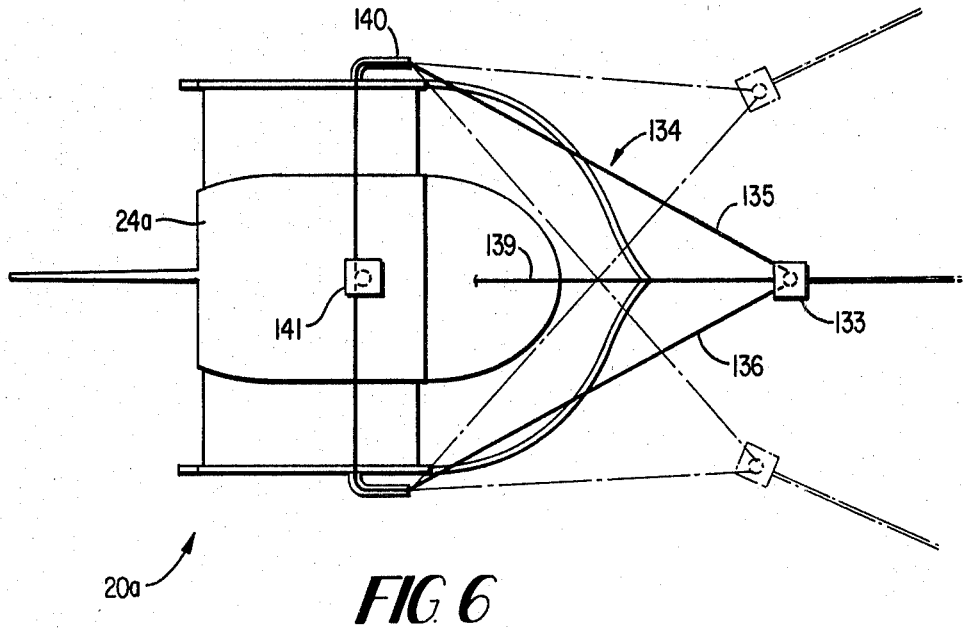
FIG 6

FIG. 7
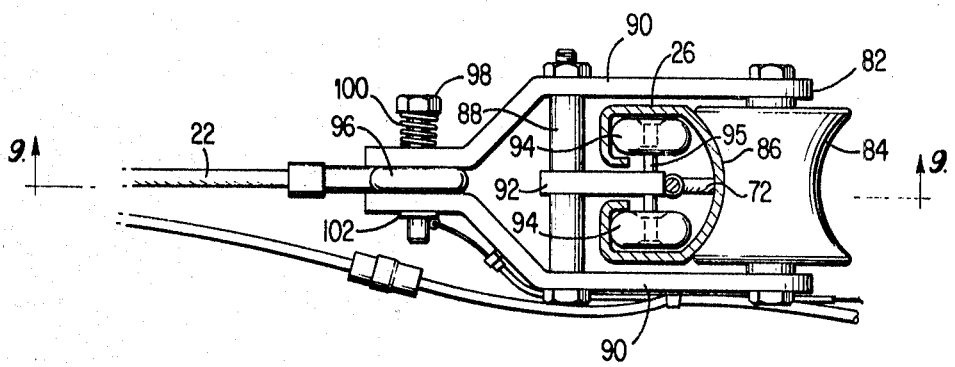
FIG. 8a
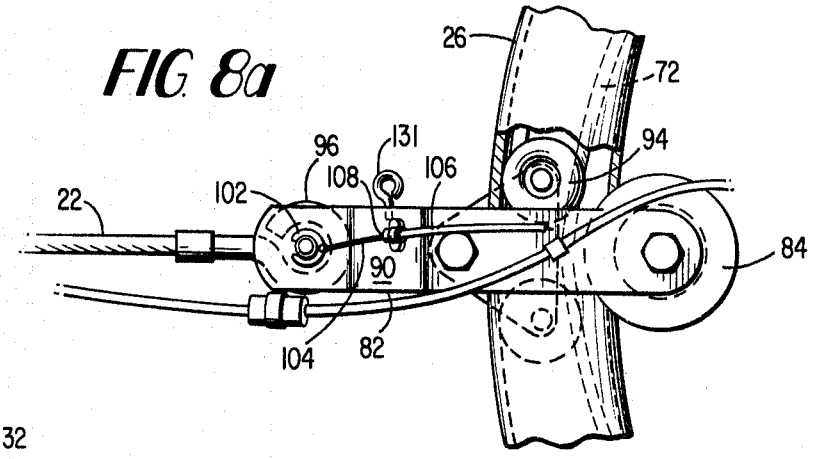
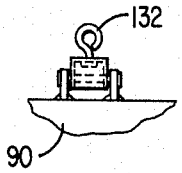
FIG. 8b
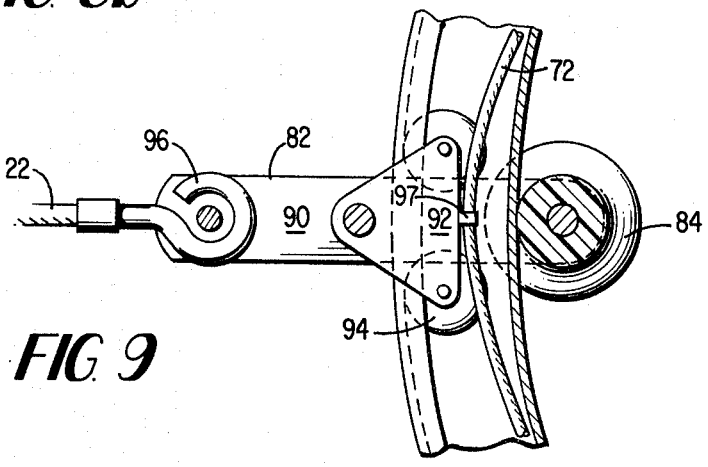
FIG. 9

FIG. 10
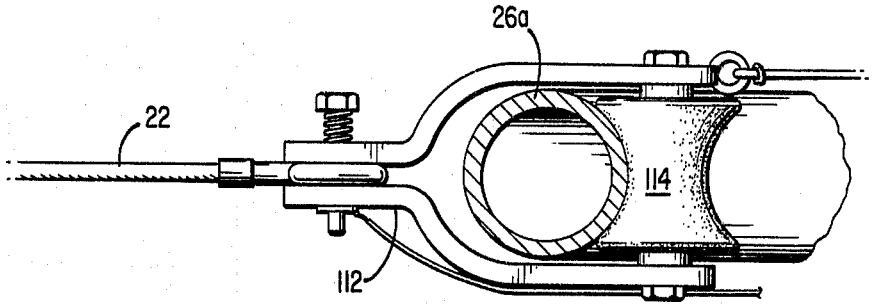
FIG. 13
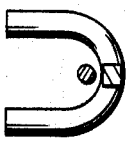
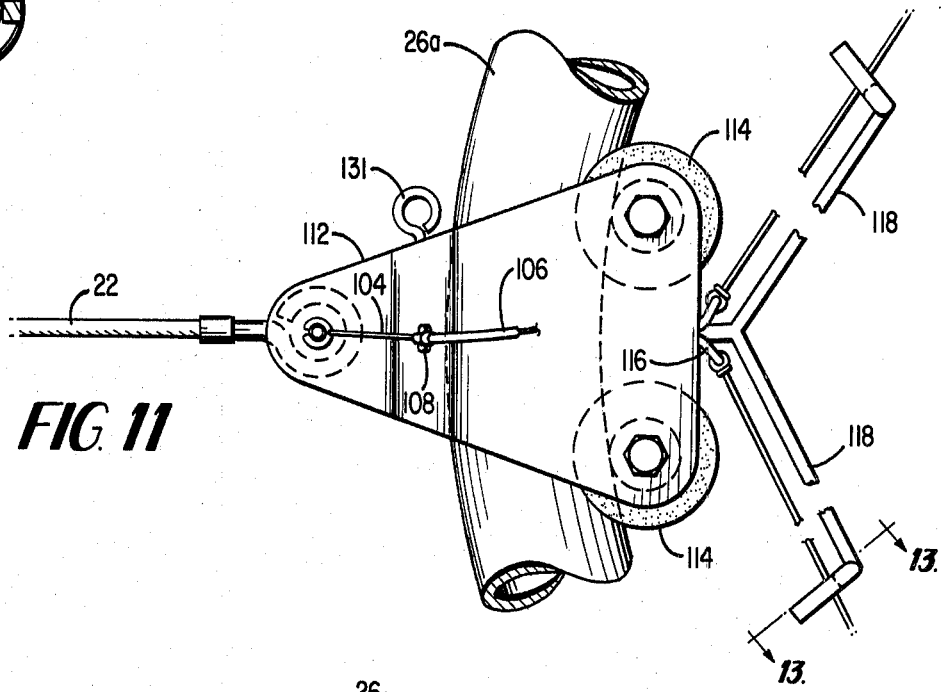
FIG. 11
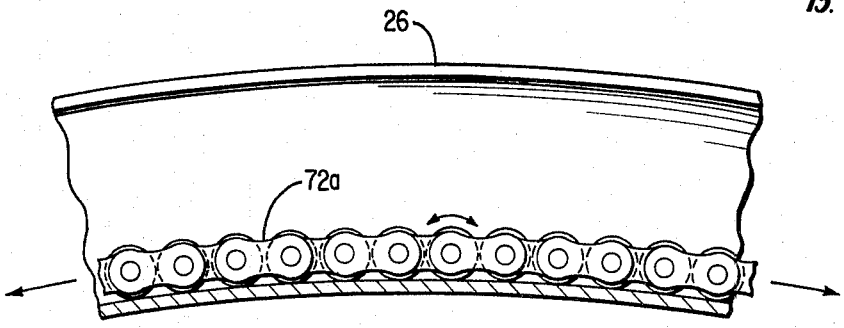
FIG. 12

LATERALLY AND VERTICALLY CONTROLLABLE UNDERWATER TOWED VEHICLE

BACKGROUND OF THE INVENTION

1. Field of the Invention

The present invention relates to a vehicle designed to be towed underwater by a mobile support ship that provides propulsion for the towed vehicle.

2. Description of the Prior Art

Presently known are underwater towed vehicles that rely solely upon a mobile surface support ship for propulsion and maneuverability. Generally, such underwater vehicles depend upon a surface-connected umbilical cable for power and data telemetry.

Such vessels have been used for hydrography, underwater exploitation and explotation, harbor mapping and surveying, mine hunting and classification, defense and military missions, and pipe and trench monitoring. Such vessels have been equipped for underwater television monitoring, underwater photography, side scan sonar mapping, and photographic and acoustic sea floor surveys. The vessels have been used to search, identify, and locate underwater objects.

Previously known towed vehicles are described in an August, 1979, publication entitled "Remotely Operated Vehicles" published by the Office of Ocean Engineering, National Oceanic and Atmospheric Administration, U.S. Department of Commerce. Such vehicles are also described in French Pat. No. 1,499,177 and U.S. Pat. Nos. 2,359,366; 2,568,549; 2,948,251; 3,474,750; 3,613,628; 3,698,339; 3,807,342; 3,824,945; and 4,108,101.

Normally, the vertical position of previously known towed vehicles is determined by the length of the towing cable, the speed of towing and the weight of cable and vehicle. No provision, other than movement of the towing vessel, is provided for adjusting the lateral position of the towed vehicle. The vehicle either follows the towing vessel dead astern or has uncontrolled lateral movement. Changes in cable tension and angle resulting from a turn result in the towed vessel "kiting" (rising in an uncontrolled manner to the surface) or sinking.

SUMMARY OF THE INVENTION

It is an object of the present invention to provide a vehicle designed to be towed underwater that can be moved both laterally and vertically with respect to a towing support vessel or ship.

The present invention provides an underwater towed vehicle that is a stable moving platform having controlled lateral and vertical movement. An advantage of a laterally controllable towed vehicle is that the vehicle will travel in a straight line tracking position either directly behind or spaced from and parallel to the path of movement of a tow vessel, in spite of underwater side sea currents or the towing vessel making a turn. A vertically adjustable underwater vehicle provides the advantage of tracking an irregular shaped sea floor or object on the sea floor, without the need to adjust the length of the towing cable. A stable platform makes it possible to continuously monitor the ocean floor, even while the vehicle is turning.

The present invention provides a vehicle that is designed to be towed underwater by a surface support ship. The term "vehicle" will be hereinafter used to describe that which is being towed, while the term "vessel" will be used to describe that which is doing the towing. The towed vehicle, which is sometimes referred to as a "fish" or "tow fish," is either manned or remotely operated. Normally, one or more tow cables interconnect the vehicle and the vessel and an umbilical cord extends from the vessel to the vehicle to establish communication between the two. Such communication is used to furnish the vehicle with energy, compressed air or suitable gas, liquid, and control signals. The communication is also used to transmit information from the vehicle to the vessel. The vessel doing the towing is preferably a surface support ship that furnishes power for forward movement, as well as control functions, for the vehicle. The support ship can also be a powered underwater vehicle, such as a submarine. Thus, the term "vessel" also identifies a surface or an underwater towing ship. All movements of the vehicle hereinafter described are when the vehicle is being towed so that the movements utilize current generated by the towing of the vehicle and the variation in the angle of attack of the vehicle with respect to such current.

With the vehicle of the present invention, there are no physical size limitations, other than those imposed by practical considerations, such as available towing power, desired functions to be performed by the vehicle, and strength of materials. One embodiment of the vehicle is folded, stowed, and transported to an operating site. Subsequently, the vehicle is assembled and put in operation. With another embodiment, the vehicle is large enough to carry several people. This embodiment is modifiable to include a diver lock-out sphere. In another embodiment, the vehicle is designed to be unmanned and carry equipment, such as marine sonar, television camera, and underwater photographic camera. The vehicles, dependent on their intended use, have main bodies that are open or are sealed and pressurized.

Another embodiment provides a large work platform carrying navigation and operational control surfaces and/or habitats with minimal planing surfaces added to the platform to provide navigation between the surface and a sea floor site. Such platform could be constructed on shore, towed close to a desired site, and then submerged by adjusting the towing point of connection and ballast.

Another embodiment is designed to be towed behind a submarine. A plurality of vehicles are interconnected sequentially to form a "sea train." The lateral movement of each vehicle is controllable either from the preceding vehicle or from the submarine, so that all parts of the train follow the same path. Such train eliminates problems presently encountered when towing a string of items when trailing items in the string tend to follow straighter, less curved paths than the towing submarine. This tendency limits the ability of presently existing trains to navigate in close quarters, such as waters containing icebergs.

With still another embodiment, the vehicle is self-powered or self-propelled so that it can independently move when the towing vessel is stopped or turning. The vehicle is also designed to be detached from the two cable for autonomous operation of limited time duration in areas of restricted movement, such as under drill platforms.

The towing speed of the vehicle is a function of the intended use of the vehicle. An embodiment of the vehicle has been navigated under full control at speeds less than one knot and at speeds above six knots. The only limitations on depth of operation are those imposed by pressure on the vehicle, cable drag, and cable weight. The vehicle is operable on a cable as short as a few meters long or a cable thousands of meters long. Since the vehicle is movable both laterally and vertically, broad bands or three dimensional patterns of vehicles are towable by one vessel and controllable with grouped or, selectively, individual controls. Vehicles are staggered in the direction of movement of the vessel so that more than one vehicle passes over an object or area to be inspected. For instance, after the first vehicle has passed a particular site, the first vehicle is moved laterally so that a second vehicle is movable laterally and possibly vertically to pass over the same site. Alternatively, the lengths of the tow cables are adjustable so that there is no need to laterally move the first vehicle. For instance, the cable towing the first vehicle is relatively short, and the vehicle is adjusted to travel almost directly underneath the towing vessel, and the cable towing the second vehicle is relatively long and trails behind the towing vessel. If necessary, the second cable has floatation collars to reduce the risk of cable interference.

Although the vehicle hereinafter described will be described in the context of being an entirely new vehicle, it will be appreciated that existing vehicles are modifiable to provide the advantages obtainable with the present invention.

The underwater towed vehicle of the present invention is based on a combination of three distinct elements, the elements interacting with each other to provide a novel and non-obvious underwater towed vehicle.

The first of the elements is a point of attachment between the towed vehicle and the vessel that is movable to assist in horizontal and vertical adjustment of the underwater vehicle with respect to the vessel, while the vehicle is being towed by the vessel. The second element is the provision of planing surfaces on the underwater vehicle that provide reaction surfaces when the point of attachment is changed to vary the orientation between the towed vehicle and the towing vessel. In order to obtain a suitable reaction, at least part of the planing surfaces must be provided forward of lateral and vertical points where structure interconnecting the cable point of attachment with the main body of the towed vehicle exerts forces on the main body. The third element is the provision of appropriate stabilization of the underwater vehicle. Such stabilization is provided by positive buoyancy, negative buoyancy (ballast), a combination of positive and negative buoyancy, adjustable stabilizing ailerons, or a combination of ailerons, buoyancy, ballast and vehicle weight.

While each of the above three elements can take many different shapes, it is the combination of the elements in the manner provided by the present invention that provides advantages not obtainable with previously known underwater towed vehicles.

The system for varying the point of attachment between the towed vehicle and vessel takes many different forms. For instance, in one form, four cables extend from the towing vessel to the towed vehicle. The cables are arranged in pairs, with one pair being connected to horizontally spaced points and the other pair being connected to vertically spaced points on the towed vehicle. By shortening the length of one cable of a pair while lengthening the length of the other cable, the orientation of the towed vehicle with respect to water streaming past the vehicle is varied. This variation results in lateral, vertical, or lateral and vertical movement of the vehicle with respect to the vessel.

Another form of the movable point of attachment utilizes four cables arranged in pairs that extend from the underwater vehicle to a common point that, in turn, is connected by a single cable to the support vessel. Appropriate mechanisms are provided at either the common point or on the towed vehicle to lengthen and shorten the cables to thereby adjust the orientation of the towed vehicle with respect to water streaming past the vehicle. Such change in orientation results in movement of the vehicle with respect to the towing vessel.

A third form of the adjustable point of attachment utilizes a generally U-shaped or arcuate-shaped member, hereinafter referred to as an "arc," that extends in front of and is connected to a main body of the underwater vehicle. A mechanism is provided on the main body for moving the arc with respect to the main body, for instance, raising and lowering the arc. A block or trolley is carried by the arc and is movable along the arc. The cable connecting the underwater vehicle to the support vessel is connected to the block so that the point of attachment is raised or lowered by movement of the arc. The point of attachment is moved from left to right, or right to left, by movement of the block along the arc.

An adjustable point of attachment is also obtained by providing the towed vehicle with adjustable ailerons or stabilizers. Such system works with either an arc or with a system utilizing four cables. When it is desired to change the relationship between a towed vehicle and a towing vessel, the ailerons or stabilizers are moved to initiate movement of the towed vehicle. Simultaneously, a mechanism locking the point of attachment in a previous position is released. As the towed vehicle shifts position as a result of water acting on the ailerons, the relationship between the point of attachment and the towed vehicle also changes. When the changing relationship between the point of attachment and the towed vehicle reaches a desired orientation, the point of attachment is again locked with respect to the towed vehicle. The ailerons are then returned to a position presenting minimum frontal area to the water through which the vehicle is moving. Accordingly, this system utilizes the forces generated during movement of the towed vehicle to change the point of attachment.

The previously described systems for changing the point of attachment are intended to be illustrative of the concept of using an adjustable point of attachment between a support vessel and a towed underwater vehicle. It will be appreciated that other systems can also be utilized. The feature of the use of a variable point of attachment, when combined with planing surfaces, results in an underwater vehicle whose orientation with respect to a towing support vessel is changed in a relatively easy manner.

When the relationship between the point of attachment and the towed vehicle is initially changed by an appropriate power-driven mechanism, or by movement of the vehicle as a result of changing the position of adjustable ailerons, the point of attack of the towed vehicle with respect to water flow past the vehicle is changed. Such change increases the frontal area being struck by the water flow which exerts forces on the towed vehicle that tend to minimize the frontal area. These forces result in movement of the towed vehicle with respect to the support vessel in a horizontal direction, a vertical direction, or combined horizontal and vertical directions. As a result, the vessel is able to tow a plurality of underwater vehicles arranged in a fan or other shape behind the ship. The underwater vehicles are also arrangeable at different water depths.

The second element of the present invention, the provision of planing surfaces, is provided by appropriately shaping the main body of the vehicle with substantially horizontal and vertical surfaces, attaching horizontal and/or vertical surfaces to the main body, or a combination of an appropriately shaped main body and attached surfaces.

For the planing surfaces to be effective, at least a portion of the surfaces must be positioned forward of the points of attachment of the arc, or other mechanism, interconnecting the tow cable point of attachment with the main body. When the towed vehicle is intended to be part of a sea train, the planing surfaces affecting vertical movement preferably are symmetric about a horizontal plane. When the towed vehicle is intended to move as a single unit, the vertical planning surfaces, at least in part, are provided by appropriately shaping the leading portion or front of the main body. For instance, since towed vehicles have a tendency to rise, the front of the main body has about two thirds of its frontal area positioned above a plane passing through the leading portion of the main body, with one third of the frontal area positioned below the plane. Thus, the vehicle has a greater frontal area or vertical planning surface acted on during downward movement than when the vehicle is moving upwards.

The third element of the present invention, the incorporation of buoyancy (positive, negative, or combination of positive and negative), stabilizing ailerons, or a combination of buoyancy and stabilizing ailerons, results in controlling movement of the towed vehicle with respect to the towing support vessel. Buoyancy minimizes any tendency of the towed vehicle to pitch and roll during movement. Thus, by changing the angle of attack of the towed vehicle on the water, both lateral and vertical control are provided of movement of the underwater vehicle, without excessive movement of the vehicle.

With the present invention, ballast (negative buoyancy) and buoyancy (positive ballast) have been used, both with and without roll stabilizing "wings". Also, ballast has been used that is movable fore and aft or movable port and starboard. A combination of ballast that is movable fore and aft and movable port and starboard also has been used. Further, fixed ballast has been used. The utilization of ballast, buoyancy, and roll stabilizing "wings," together with a selectively displaceable point of attachment, provides enhanced lateral and vertical controlled navigation.

A mechanically transported point of attachment between a towed vessel and a support vessel can have an effect of causing roll, rather than movement of the vehicle. By using buoyancy or ballast, opposing direction control planes, roll stabilizers, or a combination thereof, compensation is provided for the tendency to roll rather than move.

The function of the planing surfaces is to cooperate with the movable point of attachment to assure appropriate movement of the vehicle. With a movable point of attachment, but a flat surface, that is no opposing planing surface, a vehicle moves like a towed plate, regardless of whether or not a force is applied to the top, sides, or bottom. Provision of both horizontal and vertical planing surfaces results in an increased frontal area presented to water flowing past the vehicle when the vehicle is turned. When the frontal surface increases, there is a tendency of the vehicle to move to minimize the frontal area. These planing surfaces thereby facilitate movement of the vehicle to again minimize the frontal area. It should be noted that the connections between the movable point of attachment and the main vehicle body must be forward of a plane passing through the average area balance point of the vehicle to avoid "flipping" of the vehicle. The connection points are preferably close to such plane so that beam-wise and fore and aft control are maintained during changes of the position of the point of attachment to the towing vessel. If the connection points are too far forward or rearward of the balance point plane, control will be more difficult.

The invention, and its objects and advantages, will become more apparent in the detailed description of the preferred embodiments hereinafter presented.

BREIF DESCRIPTION OF THE DRAWINGS

In the detailed description of the preferred embodiments of the invention hereinafter presented, reference is made to the accompanying drawings which schematically illustrate the present invention. In the drawings:

FIG. 2 is a front view, slightly modified, of the vehicle of FIG. 1;

Figure 1:
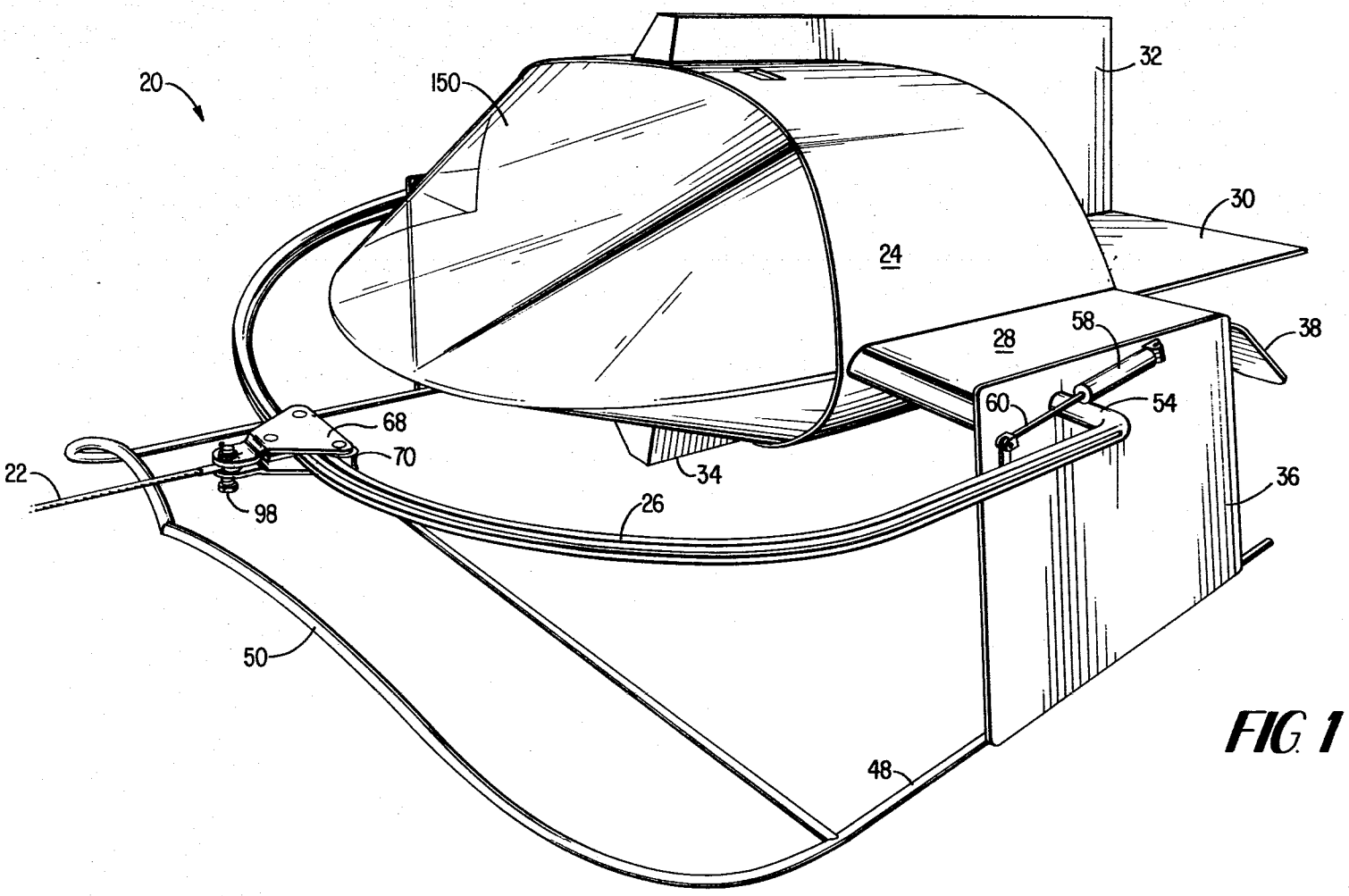
FIG. 1 is a perspective of one embodiment of an underwater towed vehicle according to the present invention.
Figure 3A:
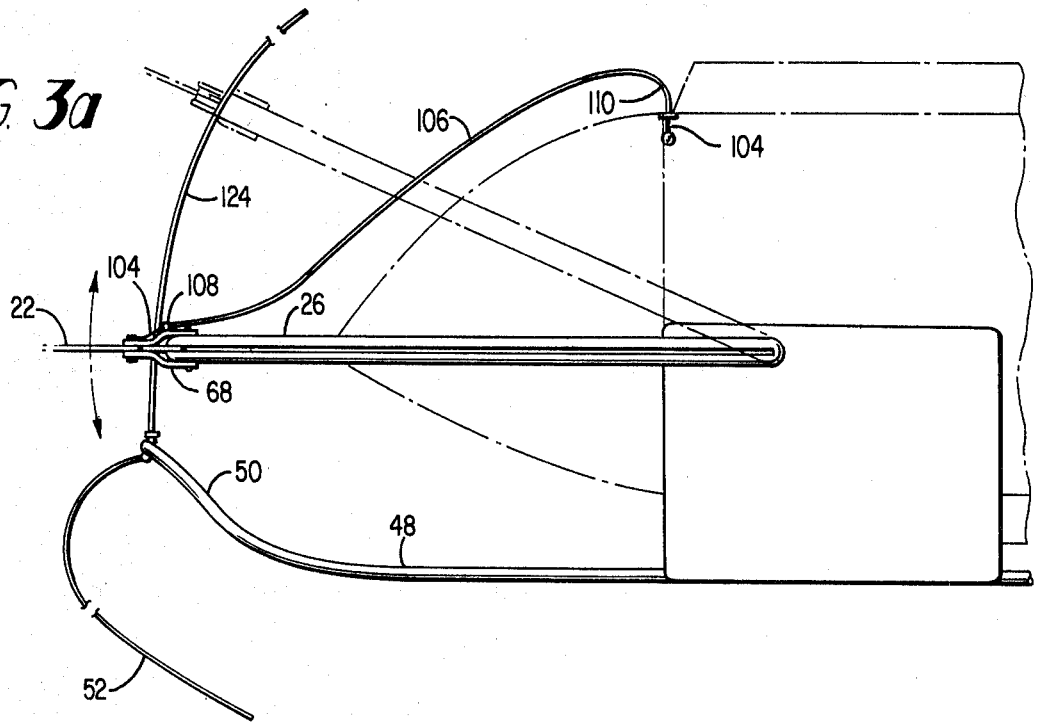
FIG. 3 is a partial vertical cross section of another embodiment of an underwater towed vehicle according to the present invention.
Figure 3B:
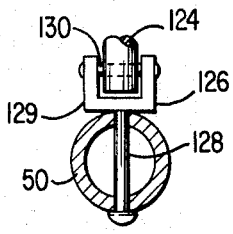

FIG. 3*a* is a schematic side view of another modification of the vehicle of FIG. 1;

FIG. 3*b* is an enlarged view, partially in section of a portion of the vehicle illustrated in FIG. 3*a;*

Figure 4:
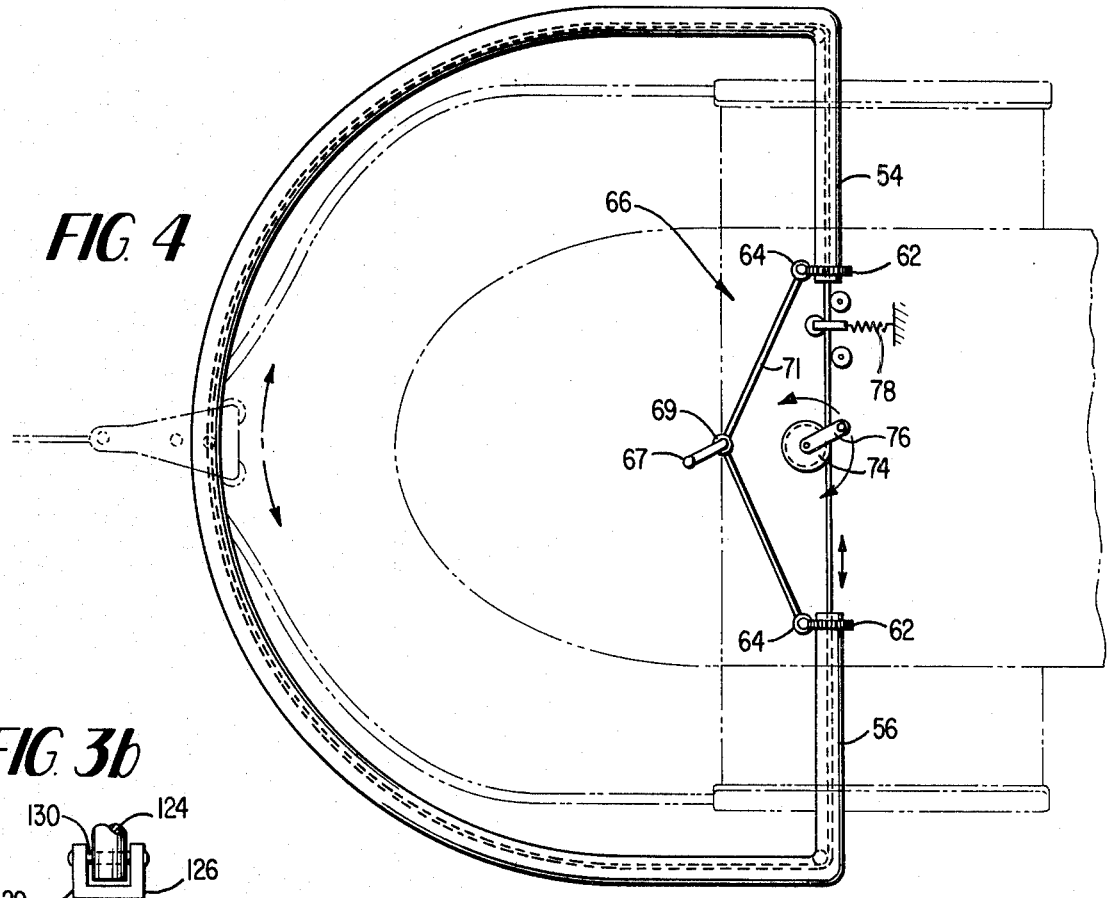

FIG. 4 is a schematic top view of the vehicle of FIG. 1 illustrating one embodiment of a control system for adjusting a tow stress point or point of attachment of a tow cable to the vehicle;

FIG. 5 is a schematic side view of another embodiment of a control system for adjusting a point of attachment of a tow cable to the vehicle;

FIG. 6 is a schematic top view of the control system of FIG. 5;

FIG. 7 is a side view, partially in section, of one embodiment of a cooperating block and arc used to vary the point of attachment of a tow cable to an underwater vehicle;

FIG. 8*a* is a top view, partially in section, of FIG. 7;

FIG. 8*b* is a view of a modified portion of the block illustrated in FIG. 7;

FIG. 9 is a section along line 9—9 of FIG. 7;

FIG. 10 is a side view, partially in section, of another embodiment of a cooperating block and arc used to vary the point of attachment of a tow cable to an underwater vehicle;

FIG. 11 is a bottom view of FIG. 10;

FIG. 12 is a view, partially in section, of a modification of the embodiment illustrated in FIGS. 7 to 9.

Figure 15:
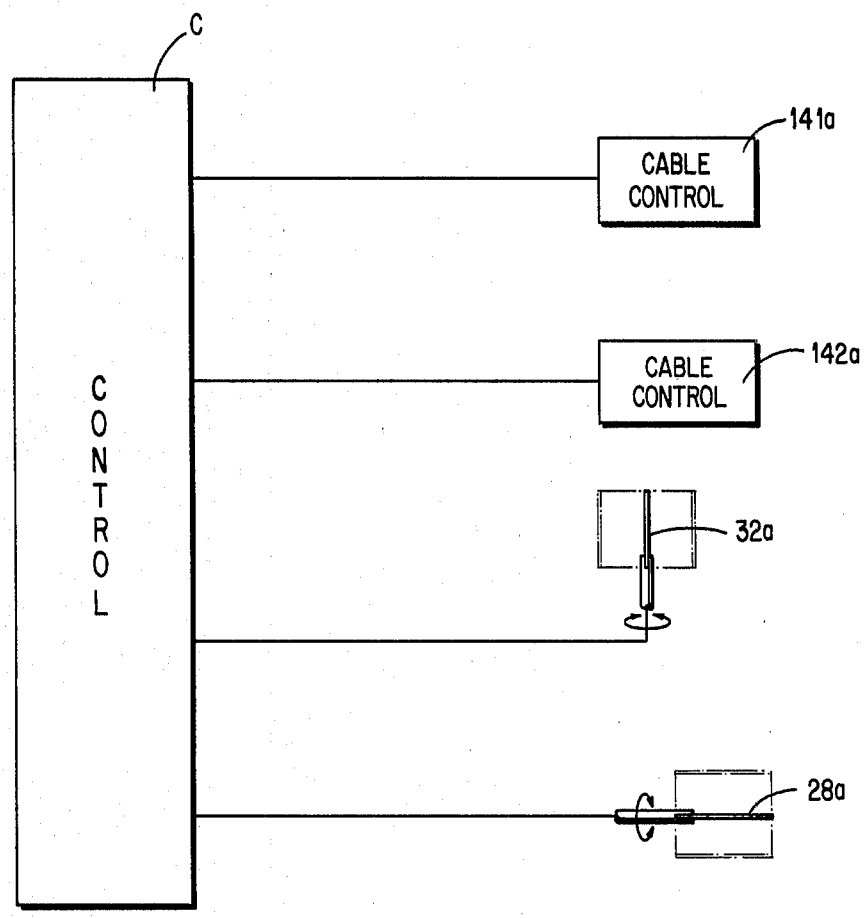

FIG. 13 is a view along line 13—13 of FIG. 11;

FIG. 14 is a partial top view of a vehicle using the cooperating block and arc illustrated in FIG. 10; and FIG. 15 is a schematic representation of another embodiment of a control system provided by the present invention.

DESCRIPTION OF THE PREFERRED EMBODIMENTS

Because underwater towed vehicles are generally known, the present description will be directed in particular to elements forming part of, or cooperating more directly with, the present invention. Elements not specifically shown or described herein are understood to be selectable from those known in the art.

In the following description, terms such as "port," "starboard," "upper," and "lower" will be used. It is to be understood that such terms are being used to facilitate the description of the illustrated invention and are not to be interpreted as limiting the arrangement of the present invention to a particular orientation. The terminology "buoyancy" will be used to identify "positive buoyancy," that is, materials that enhance the ability of the underwater vehicle to float or tend to rise when submerged, and "ballast" will be used to identify "negative buoyancy" or "ballast," that is, relatively heavy materials used to improve stability and control of the towed vehicle.

In the different figures, the same reference numerals will be used to identify the same components.

Referring now to the drawings, and to FIG. 1 in particular, one embodiment of a vehicle designed to be towed underwater, generally designated 20, is illustrated. The vehicle 20 is connected by a tow cable 22 to a vessel (not shown), such as a surface support ship or submarine. The vessel tows the vehicle 20 and, preferably, provides power and control signals to the vehicle. The vehicle 20 has a main body 24, preferably having a metallic frame covered with a suitable plastics material, such as fiberglass. An arcuate-shaped member or arc 26 is pivotally connected to port and starboard or lateral sides of the vehicle. The arc 26, alternatively, is connectable to vertically spaced upper and lower portions of the vehicle. The points of connection are spaced slightly forward of a vertical plane passing through the vehicle's center of buoyancy. Horizontal planing surfaces 28, 30 and vertical planing surfaces 32, 34, and 36 are also provided. These surfaces provide a dual function in that they enhance stability of the vehicle and provide reaction surfaces that are struck by water flowing past the vehicle during vertical or lateral movement of the vehicle. Ailerons, one of which designated 38 is illustrated, extend rearwardly from either the main body 24 or the horizontal planing surfaces 28, 30. A rudder (not illustrated), in some embodiments, is attached to either a fore or aft portion of the main body. As can be seen from FIG. 2, the main body includes substantially planer side portions 40, 42 and substantially planar top and bottom surfaces 44, 46, respectively. Shaping of main body 24 in this manner eliminates the need to use the horizontal and vertical planing surfaces 28, 30, 32, 34, and 36; however, use of such planing surfaces facilitates controlled movement of the vehicle 20.

Landing skids or a strut system 48 is connected to lower portions of the vertical planing surfaces 36 for supporting the vehicle 20 on the ocean floor or other surface. The landing skids also add ballast, especially when formed of a heavy metal. As can be seen from FIGS. 3*a* and 5, a leading portion 50 of the strut system 48 is upwardly curved and formed by the interconnection of runners or skids extending under the main body. The skids are designed to deflect the vehicle 20 away from underwater obstacles encountered during movement. A sensing system, having one or more feelers 52 extending downwardly below the strut system 48, is provided to reduce the risk of impact of the vehicle with the sea floor or with an underwater obstacle. Deflection of the feeler or feelers 52 results in the generation of a command signal that raises the vehicle to a position spaced a greater vertical distance from the obstacle.

The arc 26 has end portions 54 and 56 extending towards each other. The end portions extend inwardly through the planing surfaces 36 and terminate either within the planing surfaces 28 or the main body 24, depending on the particular system used to control movement of the arc.

One arc control movement system, as illustrated in FIG. 1, includes piston-cylinder units having cylinders 58 connected to the planing surfaces 36 and pistons 60 connected to the arc 26. The particular points of connection of the pistons 60 to the arc 26 are a function of both the length of piston travel required to control movement of the arc and the need to minimize bending forces on the arc during its movement by the pistons. The cylinders 58 are hydraulically or pneumatically controlled by lines extending from the main body through the planing surfaces 28.

With another system for controlling movement of the arc 26, as illustrated in FIG. 4, the ends 54 and 56 of the arc extend into the interior of the main body 24. With this embodiment, sets of gear teeth 62 are provided on portions of the arms 54, 56. Gears 64 engage the gear teeth 62 to raise and lower the arc 26. A manually-operated gear mechanism 66 having a rotatable lever 67, a gear mechanism 69 rotated by the lever 67, and shafts 71 interconnecting gear mechanism 69 with the gears 64 controls rotation of the gears 64. It will be appreciated that a lever or a power-driven control can be used with, in addition to, or in place of the gear mechanism 66.

Referring again to FIG. 1, a block 68 is illustrated that is laterally movable on the arc 26 to adjust the lateral position of the tow stress point or point of attachment of the tow cable to the arc. For this purpose, the block 68 has rollers 70 mounted for rolling movement on inner surfaces of the arc 26. The tow cable 22 terminates in an eye loop that is connected by a bolt 98 to the block 68. A cable (not shown in FIG. 1) is positioned inside the arc 26 and connected to the block 68 to control movement of the block with respect to the arc 26.

Referring to FIG. 4, a suitable mechanism for controlling movement of the block 68 is illustrated. In this embodiment, a chain or cable 72 has ends thereof connected to the block 68 to form a continuous loop. Alternatively, the ends are interconnected to each other to form a continuous loop, and the block is clamped to the loop. The cable is wrapped around a winch 74 that is manually operable by a lever 76 when it is desired to change the position of the block 68. Preferably, at least one cable tensioner 78 is provided on one or both sides of the winch 74 to ensure that driving contact is maintained between the cable and winch.

FIGS. 2 and 7 to 9 illustrate a modified embodiment, designated 82, of the block. As illustrated in FIGS. 7 to 9, the block 82 includes an arcuate-shaped roller 84 shaped to roll on a convex-shaped outer surface 86 of the arc 26. A bolt 88 is interconnected between side plates 90 of the block 82 and supports a bracket 92. Rollers 94 are connected by a shaft 95 to the bracket 92. During movement of the block 82 along the arc 26, the rollers 94 roll on inner surfaces of the arc. The bracket 92 carries a clamp 97 that clamps the cable 72 to the block 92. As previously described in connection with the description of block 68, tow cable 22 has an eye loop 96 formed at its end that is connectable to the block 82. For this purpose, a bolt 98 is inserted through apertures formed in the side plates 90. A spring 100 is disposed between the head of the bolt 98 and one of the plates 90 in order to bias the bolt away from the block 82. A reduced diameter portion is formed in the distal end of the bolt 98 that receives a locking key 102. Alternatively, a bore extends through the distal end that receives a cotter key (not shown). A cable 104 extends from the key 102 to the main body 24 of the vehicle 20. A protective sheath 106 has one end 108 connected to the block 82 and one end 110 connected to the main body 24. The sheath 106 ensures that only a slight movement of the cable 104 will be required to separate the key 102 from the bolt 98, regardless of the position of the arc 26. Upon removal of the key 102, the spring 100 expands to separate bolt 98 from the block 82 thereby disconnecting tow cable 22 from the block.

Referring now to FIGS. 10 and 11, another embodiment of a block suitable for connecting a tow cable 22 to an underwater vehicle 20 is illustrated. The block, which is designated 112, is intended for use with an arc **26*a* that is formed as a closed tubular member. The block 112 includes rollers 114 shaped to roll on inner surfaces of the arc 26*a* and is bolt-connected to a loop at the end of cable 22. The arc 26*a* is raised and lowered in a manner similar to arc 26, with the cable used to move the block along the arc connected to a portion 116** of the block not encompassed within the arc.

In order to minimize the possibility of contact between the cable connected to the block 112 and the front of the main body, guide arms 118 for the cable extend inwardly from the block 112. Distal ends 120 of the arms 118 are bent back toward the arc and are either arcuate shaped, as illustrated in FIG. 13, or V-shaped, to provide guides for movement of the cable.

Use of the block 112 to control cable position during movement of a tow stress point or point of attachment of a cable to a vehicle is schematically illustrated in FIG. 14. It should be noted that the cable extends from the block 112, around pulleys 122 connected to the arc **26*a*, to the main body of the vehicle. As illustrated in solid lines, when the tow stress point is centrally located on arc 26*a*, both of the distal ends 120 contact and guide the cable from the block to the pulleys 122. When the block moves laterally to port, a portion of the block contacts pulley 122, or another suitable stop, to limit lateral movement of the block. At this time, as illustrated in phantom in FIG. 14, the portion of the cable connected to the port side of the vehicle extends from the port side pulley 122 to the port side of the main housing of the vehicle, without being guided by the port side distal end 120. The portion of the cable connected to the starboard side of the vehicle extends from the block 112, through the starboard side distal end 120 and pulley 122 to the starboard side of the main housing. Thus, the starboard side distal end 120 of guide arm 118 cooperates with the starboard side pulley 122 to ensure that the cable does not contact the housing when the block is moved to the port side of the arc. It will be appreciated that movement of the block 112** to starboard is accomplished in a similar manner.

Referring now to FIG. **3*a*, a protective deflector 124 is illustrated that extends upwardly from a foreward portion of the strut system 48. The function of the deflector is to protect the main housing by deflecting downwardly below the strut system and away from the vehicle any foreign material encountered and directed down the tow cable 22 during movement. Thus, the deflector 124 and strut system 48** cooperate with each other to protect the main housing.

As schematically illustrated in FIG. **3*b*, a lower end of the deflector 124 is connected to strut 50 by a connector 126 that allows both rotational and pivotal movement of the deflector with respect to the strut. Such movement is required because of the block's movement in both vertical and lateral directions. Connector 126 includes a shaft 128 rotatable with respect to the strut 50 and a U-shaped portion 129 supporting a shaft 130 interconnecting the deflector 124 with the connector 126** in such manner that the deflector is rotatable with respect to the connector.

FIGS. **8*a* and 11 illustrate one embodiment of a connector 131 used to guide movement of a deflector 124 with respect to a block connecting a tow cable to the vehicle. The connector 131 has one end connected to the block and one end forming a closed loop. The diameter of the loop is larger than the diameter of the deflector 124** so that a deflector inserted through the loop is guided in all positions of the block.

FIG. **8*b* illustrates another embodiment, designated 132, of a connector used to guide movement of the deflector with respect to the block. Connector 132, like connector 131, has one end forming a closed loop for guiding the deflector and one end connected to the block connecting the tow cable to the arc. The connector 132**, however, is mounted in such manner that the closed loop is both pivotal and rotatable with respect to the block.

Considering now FIGS. 5 and 6, another system suitable for interconnecting a tow stress point with a towed underwater vehicle is schematically illustrated. The vehicle, which is generally designated **20*a*, is similar to the previously described vehicle 20 and includes a main body 24*a* and appropriate horizontal and vertical planing surfaces, similar to the surfaces 28, 30, 32, 34, and 36. With this embodiment, the tow stress point or point of connection 133 is connected to the main body 24*a* or appropriate ones of the planing surfaces by a first pair of cables 134 having one section 135 connected to a port side of the vehicle and one section 136 connected to the starboard side of the vehicle. A second pair of cables 137 has a first section 138 connected to a lower section of the main body 24*a* and a second section 139 connected to an upper portion of the main body. The vertical points of connection are preferably spaced slightly forward of a vertical plane perpendicular to the center line and passing through the center of buoyancy of the vehicle. If the points of connection are spaced too far forward, there would be too quick a response of the vehicle to a change in the position of the tow stress point 133 which would result in uncontrolled movement of the vehicle. Likewise, if the points of connection were positioned too far aft, there would be a tendency to flip the vehicle. The horizontal points of connection preferably are located close to or in a horizontal plane passing through the center of buoyancy close to or in a vertical plane perpendicular to the vehicle center line and passing through the center of buoyancy. Preferably, cable guide tubes, extenders, or guide assemblies 140 extend away from the vehicle to reduce the risk of contact between the pairs of cables and portions of the main body 24***a*. To facilitate movement of the cables through the extenders, one or more pulleys (not illustrated) are positioned within the extenders. The risk of contact between the cables and the main body can be further reduced by positioning a fixed length rod between the tow stress point 133 and a portion of the main housing. The connection between the fixed length member and the main housing is such that the end of the fixed length member connected to the tow stress point 133 is horizontally and vertically movable with respect to the other end.

Several different methods are utilized to interconnect the tow stress point 133, the pairs of cables 134 and 137, and the vehicle 20*a*. First, the tow stress point 133 is positionable on the towing vehicle, as schematically illustrated by the position labelled "Y" in FIG. 5. With this method, four separate cable sections extend between the towing vessel and towed vehicle. Preferably, the cables extend in a single unit, that is faired to reduce cable drag, from the towing vessel to a point, which is labelled "X" in FIG. 5, spaced from the towed vehicle. At this point, the cable sections are separated from each other and extend to their points of attachment to the towed vehicle. With this method of connection, mechanisms, such as winches, aboard the towing vessel are used to adjust the relative lengths of the cable sections to vary the point of attack of the towed vessel with respect to water flowing over its planing surfaces.

With a second method of connection, a single tow cable extends between the positions "X" and "Y" and the pairs of cables extend between the position "X" and the towed vehicle. With this method, two different types of control systems are used. With a first control system, the tow stress point is sufficiently large to house winches or other suitable mechanisms for adjusting the relative lengths of the cable sections. With a second control system, ends of the cable sections are connected to the tow stress point 133 and suitable cable moving mechanisms 141 and 142 are located aboard the towed vehicle. Such cable moving mechanisms are power driven, manually operated, single cable locking or clamping mechanisms, or some combination thereof. For instance, as illustrated in FIG. 15, when orientation of the towed vehicle is changed by control means C moving the position of horizontally and vertically adjustable planing surfaces or ailerons, for example, surfaces 32*a* and 28*a*, one or both of the locking mechanisms 141*a*,142*a* is actuated by control means C to release clamped cable sections so that the point of attachment or tow stress point 133 is free to move when the orientation of the towed vehicle changes. After such change, the released mechanism or mechanisms is actuated to again lock the cable in a desired orientation.

Referring now to FIG. 12, an embodiment of the invention is illustrated that utilizes a chain 72*a*, instead of a cable to move a block along the arc 26. The chain 72*a* has rollers that roll on an inner surface of the arc 26 during movement of the chain 72*a* by a winch or other suitable mechanism within the main body 24. Advantages obtainable through use of the chain 72*a* include reduced friction forces between the chain and arc during movement of a block and the ability to use a positive drive that engages with the chain, instead of a friction drive, as required when using a cable.

As previously discussed, the underwater vehicle of the present invention has many different forms and uses. For instance, the embodiment illustrated in FIG. 1 is provided with a one-piece, seamless front glass 150 designed to provide minimal optical interference for a television or photographic camera positioned within the main housing. Plexiglas is a suitable material for forming the glass 150. Approximately the upper two thirds of the glass 150 forms a planing surface that assists in controlling downward movement of the towed vehicle.

With the embodiment illustrated in FIG. 2, a front glass 150*a* is illustrated that is formed in sections. This embodiment is intended to carry two divers, each being able to look out through one of the sections of the glass 150*a*.

FIG. 3 illustrates an embodiment intended for sonar scanning of the bottom. For this purpose, a transponder array 160 is mounted on a forward portion of the strut system 48. Preferably, the strut system is formed of solid material, such as carbon or suitable plastics material, that provides minimum interference with the functioning of the transponder array. The array includes a linearly extending transmitter 162 and a correspondingly extending receiver 164. A plurality of sealed cannisters or open containers 166, 168, 170, 172, 174, and 176 are provided within the main body of the vehicle to house control systems for the transponder array, telemetry equipment for communicating with the towing vessel, storage space for gear and supplies and equipment, such as a motor 178, for moving a block with respect to an arc, such as arc 26, pivotally connected to the main body. As can be seen from FIG. 3, the upper portion of the main body is filled with lightweight, non-compressible plastic particles that enhance the buoyancy of the vehicle. Preferably, buoyancy also is provided in the horizontal planing surfaces. Positioning of the heavier control components, such as a motor 178 and associated reduction gearing, in lower portions of the main body provides ballast that enhances the stability of the vehicle. The size of the motor 178 is a function of the size of the vehicle. For instance, in some operations, a motor as small as one half horsepower or smaller has been found suitable, while in other embodiments a several horsepower motor is required. When necessary, additional ballast is added to area 180 of the main body.

Considering now some representative controlled movements obtainable with towed vehicles provided by the present invention.

First, when it is desired to dive or move vertically lower a vehicle of the type illustrated in FIG. 1, the pistons 60 on the port and starboard sides of the vehicle are moved out of their respective cylinders 58 so that the arc 26 is positioned below a plane passing through the center of buoyancy of the vehicle. Changing the position of the arc varies the angular orientation of the towing force exerted on the towed vehicle and will result in changing the point of attack of the horizontal planing surfaces so that the vehicle will tend to dive. The increased frontal area will facilitate such downward movement of the vehicle. The vehicle will continue to dive until it reaches a position presenting minimum frontal area to water flowing past the vehicle. The vehicle will then stay at a constant depth. Similarly, when it is desired to raise the vehicle, the pistons 60 are retracted into the cylinders 58 so that the arc 26 moves in an upward direction. Such movement will result in a change in the orientation of the planing surfaces of the towed vehicle which, accordingly, will cause the vehicle to move upwards. After the vehicle has reached a new depth at which the planing surfaces present minimum frontal areas, upward movement stops and the vehicle travels at a uniform depth.

It will be appreciated that the mechanism 66 illustrated in FIG. 4 can be used in the same manner as the cylinders 58 and pistons 60 to control vertical movement of the vehicle.

Referring now to FIG. 2, when lateral movement of a vehicle is desired, the block 82 is moved along the arc 26. For instance, if the vehicle is travelling astern of the towing vessel and a lateral move to port is desired, block 82 is moved by a suitable mechanism, such as lever 74 illustrated in FIG. 4, towards arc end portion 56, as illustrated in phantom in FIG. 2. Such movement will result in a change in the point of attack of the towed vehicle on water flowing past the vehicle. This change in orientation will result in lateral movement of the towed vehicle to port. Such lateral movement will continue until the vertical planing surfaces again present a minimum frontal area or point of attack. Lateral movement of the vehicle will then stop and the vehicle will travel a path parallel to the path being travelled by the towing vessel.

It has been found that lateral movement of the block on the arc results in an effective change in the vertical forces exerted by the points of attachment of the arc on the main body. In order to maintain constant the vertical depth of the vessel, such force change is compensated for by movement of the arc. For instance, when the point of attachment moves from a central portion towards one side, the arc is raised to compensate for the change in vertical forces resulting from lateral movement of the block or point of attachment.

Movement of the vehicle illustrated in FIGS. 5 and 6 is accomplished in much the same manner as movement of vehicles having tow stress points connected to blocks movable along arcs. For instance, if it is desired to raise the vehicle illustrated in FIG. 5, winch 142 is actuated to move cable sections 138 and 139 in the directions of arrows "A" in FIG. 5. Since the ends of the cable sections are connected to the stress point 133, cable section 138 is lengthened, while section 139 is shortened. This change in relative lengths of the cables results in a change in the forces acting on the vehicle through the points of connection of the cable sections to the vehicle. This change in forces results in changing the point of attack of the planing surfaces of the vehicle, thereby causing the vehicle to rise. As the vehicle rises, it carries with it the point of attachment 133. Thus, the movement of the point of attachment 133 both leads and follows movement of the towed vehicle. As a vehicle moves upwards as a result of the change of its point of attachment, the forces acting on the horizontal planing surfaces gradually reduce until the angle of attack or frontal area of the towed vehicle is minimized. When this point is reached, further upward movement of the vehicle stops, until the point of attachment is again changed. In a like manner, the vehicle is moved laterally by actuating mechanism 141 to change the relative lengths of cable sections 135 and 136.

It is also possible to simultaneously move the vehicle in both lateral and vertical directions. During such movement, the point of attachment 133 is movable in such manner that only one section of each pair of cables is stressed by the towing force.

It will be appreciated that lateral and vertical movement is obtained in the same manner when the cable length adjusting mechanisms are located at either position "X" or "Y" in FIG. 5. When the adjusting mechanisms are located in either of these two positions, the mechanisms 141 and 142 are no longer needed on the vehicle 24*a*. Instead, ends of the cable pairs are fixedly connected to appropriate points on the vehicle 20*a*.

Previously, specific embodiments of the present invention have been described. It should be appreciated, however, that these embodiments have been described for the purposes of illustration only, without any intention of limiting the scope of the present invention. Rather, it is the intention that the present invention be limited only by the appended claims.

What is claimed is:

1. A vehicle for movement underwater, said vehicle being connectable to an end of a tow cable extending away from a towing vessel and comprising:

a main body;

means for stabilizing said main body;

planing surfaces positioned on said main body for enhancing controlled lateral and vertical movement of said main body when said vehicle is being towed; and means for interconnecting said main body with the end of a tow cable extending away from a towing vessel; and control means for effecting relative horizontal and vertical movement between the means for interconnecting and the planing surfaces to thereby vary forces exerted on said main body by the tow cable and effect horizontal and vertical movement of the vehicle with respect to the towing vessel, the relative movement between the means for interconnecting and the planing surfaces resulting in changing the point of attack of the towed vehicle on water flowing past the vehicle whereby said planing surfaces present an increased frontal area to the water thereby moving the vehicle with respect to the vessel towing the tow cable.

2. A vehicle according to claim 1, wherein the means for stabilizing includes buoyant material positioned in an upper portion of the main body and ballast positioned in a lower portion of the main body.

3. A vehicle according to claim 1 or 2, wherein the means for interconnecting transfers towing forces from the tow cable to vertically-spaced portions of said main body, said portions being located forward of a vertical plane extending perpendicular to a center line of said main body and passing through the center of buoyancy of said main body.

4. A vehicle according to claim 3, wherein the means for interconnecting transfers towing forces from the tow cable to laterally-spaced portions of said main body.

5. A vehicle according to claim 4, wherein portions of said planing surfaces are positioned fore of said vertically-spaced and said laterally-spaced portions of said main body.

6. A vehicle according to claim 1 or 2, wherein the means for interconnecting comprises:

an at least partially arcuate shaped member extending forwardly from sides of said main body;

means for interconnecting said shaped member and said main body in such manner that the center of said shaped member is movable in a vertical plane passing through the centerline of said main body;

means for vertically moving the center of said shaped member with respect to said main body;

a block guided for movement along said shaped member and having the tow cable connectable to a portion thereof; and means for moving the block along said shaped member, the point of attack of the vehicle being changed by vertically moving said shaped member, by moving said block along said shaped member, and by combined movement of said shaped member and said block.

7. A vehicle according to claim 1, wherein said control means moves said planing surfaces to effect relative movement between the planing surfaces and the means for interconnecting.

8. A vehicle according to claim 1, wherein said control means moves said means for interconnecting to effect relative movement between the planing surfaces and the means for interconnecting.

9. A towed underwater vehicle laterally and vertically movable with respect to a towing vessel connected by a tow cable to the vehicle, said vehicle comprising:

a main body;

horizontal and vertical planing surfaces connected to said main body;

means for stabilizing said main body including buoyant materials positioned in an upper portion of said main body and ballast positioned in a lower portion of said main body;

an at least partially arcuate shaped member encompassing a forward portion of said main body and connected planing surfaces and having a central portion extending forwardly of said main body, end portions of said shaped member extending towards each other through horizontally coplanar portions of planing surfaces located on sides of said main body to thereby connect said shaped member to said planing surfaces, at least a portion of said horizontal and vertical planing surfaces being positioned fore of the regions of the planing surfaces receiving said end portions of said shaped member;

means for raising and lowering the central portion of said shaped member with respect to said main body;

a block guided for movement along said shaped member, said block including means for connecting an end of a tow cable thereto;

means for controlling movement of said block along said shaped member; and controlled movement of said vehicle with respect to a towing vessel being obtained by moving the end of the tow cable connected to said block by movement of said block along said shaped member, by vertical movement of the central portion of said shaped member, and by conjoint movement of said block and said shaped member, moving of the end of the tow cable changing the point of attack of the vehicle on water flowing past the vehicle to thereby increase the frontal area of the vehicle struck by the water whereby the vehicle moves with respect to the towing vessel to minimize the frontal area struck by the water.

10. A vehicle according to claim 9, wherein said means for raising and lowering the central portion comprises piston-cylinder units having cylinders connected to portions of the planing surfaces receiving said end portions of said shaped member and pistons connected to portions of said shaped member so that movement of said pistons controls movement of said central portion.

11. A vehicle according to claim 9, wherein said main body has an external profile shaped to cooperate with said horizontal and vertical planing surfaces to control movement of said vehicle with respect to the towing vessel.

12. A vehicle according to claim 9, wherein said end portions of said shaped member extend inside said main body, said means for raising and lowering the central portion comprising means positioned inside said main body for rotating said end portions to thereby raise and lower the central portion.

13. A vehicle according to claim 9, wherein said means for controlling movement of said block comprises a cable connected to and extending from said block to port and starboard sides of said main body, and means positioned within said main body for moving said cable so that said block is moved along said shaped member.

14. A vehicle according to claim 13, wherein said shaped member is a closed tubular member and wherein pulleys are connected to said tubular member for guiding movement of said cable.

15. A vehicle according to claim 13, wherein said shaped member is an open tubular member, and wherein cable connected to said block is encompassed within said tubular member.

16. A towed underwater vehicle laterally and vertically movable with respect to a towing vessel connected by a plurality of tow cables to the vehicle, said vehicle comprising:

a main body;

horizontal and vertical planing surfaces connected to said main body;

means for stabilizing said main body including buoyant materials positioned in an upper portion of said main body and ballast positioned in a lower portion of said main body;

said plurality of tow cables being arranged in a first pair of cables connected to laterally spaced portions of the main body and a second pair of cables being connected to vertically spaced portions of the main body, the cables of each pair being interconnected to each other so that when one of the cables of a pair is lengthened the other cable of the same pair is simultaneously shortened; and means carried by the towing vessel for controlling the lengths of the cables forming each pair of cables, control of movement of said vehicle with respect to the towing vessel being accomplished by changing the relative lengths of at least one of said pairs of cables so that the angle of attack of the planing surfaces of said vehicle is changed with respect to water flowing past the vehicle thereby increasing the frontal area of the vehicle struck by the water whereby said vehicle moves with respect to the vessel to minimize the frontal area struck by the water, said means for stabilizing cooperating with planing surfaces struck by the water to control movement of said vehicle.

* * * * *